United States Patent [19]

Forsythe et al.

[11] 4,048,455

[45] Sept. 13, 1977

[54] PRESSURE SWITCH WITH PLURAL AXES PIVOTED CONDUCTION PLATE

[75] Inventors: Alan K. Forsythe; Charles J. Green, both of Vashon Island, Wash.

[73] Assignee: Red Dot Corporation, Seattle, Wash.

[21] Appl. No.: 704,479

[22] Filed: July 12, 1976

[51] Int. Cl.[2] ..... H01H 35/24

[52] U.S. Cl. ..... 200/81.4; 200/153 T

[58] Field of Search ..... 200/83 R, 83 P, 83 S, 200/83 A, 81.4, 81 R, 153 T, 160, 67 D, 67 B, 67 E, 67 G; 340/229, 240

[56] References Cited

U.S. PATENT DOCUMENTS

| | | | |
|---|---|---|---|
| 3,670,116 | 6/1972 | Cryer | 200/67 G |
| 3,898,405 | 8/1975 | Weber | 200/83 S |
| 3,946,174 | 3/1976 | Herbst | 200/153 T |

*Primary Examiner*—Gerald P. Tolin

*Attorney, Agent, or Firm*—Graybeal, Barnard & Uhlir

[57] ABSTRACT

A conductive member of plate form is supported on a spring biased member into a static postion of contact at a first corner with a support surface and at a second adjacent corner with a first contact member. A load applying member makes contact with the conductive member on the side thereof opposite from the spring biased support. A low rising pressure acting through the load applying member swings the conductive member in position about a first axis defined by its locations of contact with the support surface and the first contact member into a position in which it also contacts a second contact member and completes a conductive path between the two contact members. An intermediate rising pressure signal causes the conductive member to swing in position about a second axis defined by its locations of contact with the two contact members and against the operator of a micro-switch. A high rising pressure signal causes the conductive member to swing in position about a third axis defined by its locations of contact with the operator of the micro-switch and with the second contact member and move out of contact with the first contact member, to in that manner open the conductive path between the two contact members.

12 Claims, 13 Drawing Figures

Fig. 3
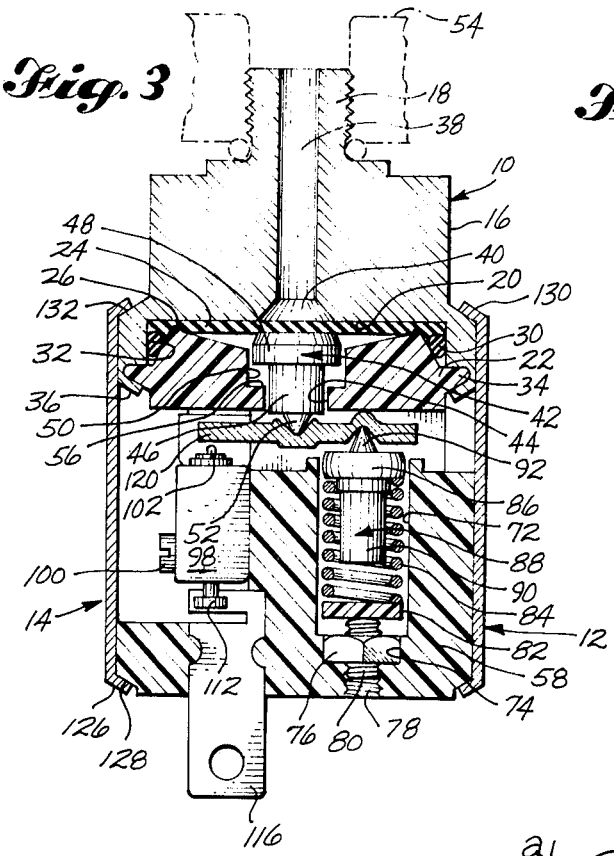
Fig. 4
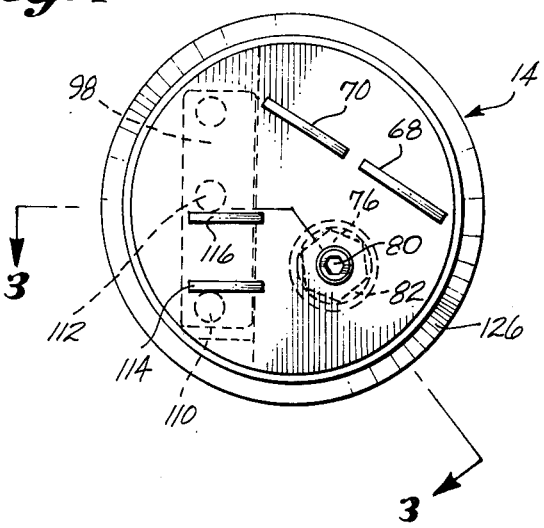
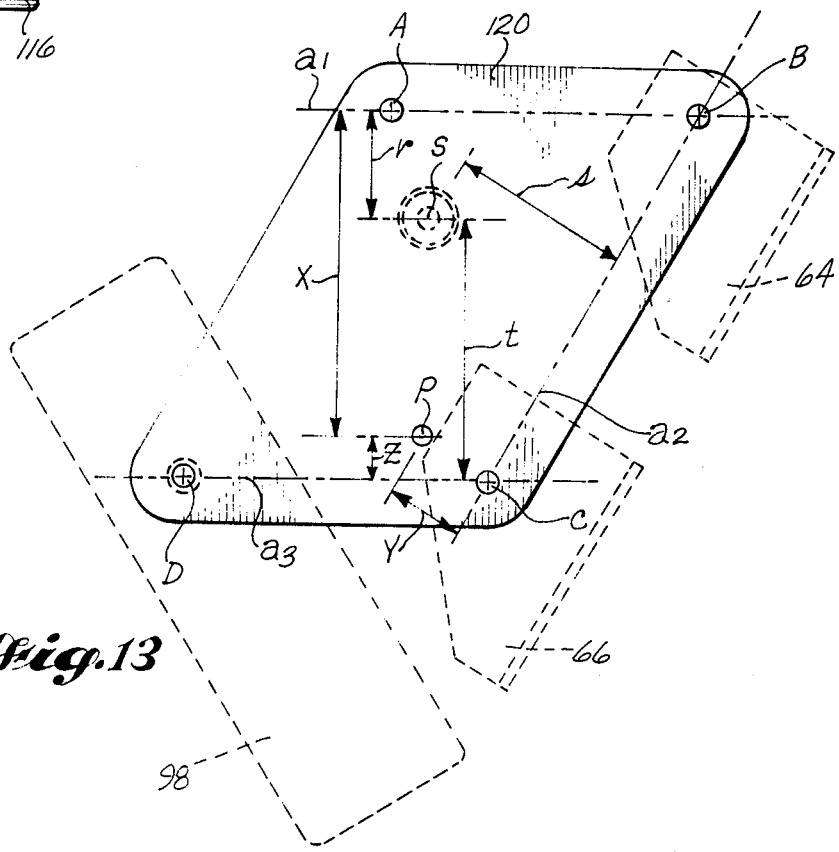
Fig. 13

PRESSURE SWITCH WITH PLURAL AXES PIVOTED CONDUCTION PLATE

BACKGROUND OF THE INVENTION

1. Field of the Invention

This invention relates to an electric switch mechanism and in particular to a multi-function switch mechanism which is responsive to a single variable singal, e.g. a pressure signal.

2. Description of the Prior Art

Pressure signal operated switches are well known. It is also well known to use a plurality of pressure switches in combination, arranged to open or close electrical circuits in response to different pressure level signals from a single source of pressure. However, the use of multiple switches requires the availability of a like number of suitable mounting locations for the switches, multiple taps into the pressure system, and multiple conduits leading from the tap points to the switches. In some installations there are fewer suitable locations for pressure switches and/or tap-in points than there are functions to be controlled by a pressure signal. An object of the present invention is to provide a single switch mechanism, requiring only a single tap-in point, which is adapted to perform plural switching functions in response to its receipt of differing pressure level signals.

Examples of known switches and switch systems which have become a part of the patent literature are shown by the following U.S. Pat. Nos. 2,985,732, granted May 23, 1961 to Ian C. Russell; 3,043,929, granted July 10, 1962, to George C. Guthrie; 3,393,612, granted July 23, 1968, to Joseph E. Gorens and Walter E. Levine; 3,109,908, granted Nov. 5, 1963, to Bertil H. Clason; 3,432,633, granted Mar. 11, 1969, to Gustave A. Sherb; 3,444,341, granted May 19, 1969, to Perceptimus J. Mighton 3,501,959, granted Mar. 24, 1970 to Sherman E. Womack; 3,516,279, granted June 23, 1970 to Robert J. Maziarka; 3,657,501, granted Apr. 18, 1972, to Harold R. Hoyt; 3,735,071, granted May 22, 1973, to George R. Burnett and Gussie E. Burnett; 3,786,210, granted Jan. 15, 1974, to Peter M. Byam; 3,898,405, granted Aug. 5, 1975, to Ernesto Juan Weber and 3,911,238, granted Oct. 7, 1975, to Noel A. Otto and Roger G. Riefler. These patents should be studied when evaluating the present invention and putting it into proper perspective relative to the prior art.

SUMMARY OF THE INVENTION

The switch mechanism of the present invention is basically characterized by a conductive plate or lever which is adapted to rotate or tilt about different axes in response to different loads applied to it by a sensing device.

According to one aspect of the invention, the conductive member or lever is caused to tilt about an axis which includes its location of contact with a first contact member, into contact with a second contact member, to complete a conductive path between the two contact members. Then, in response to a high signal, the same conductive member is adapted to tilt about an axis which includes its location of contact with the second contact member, away from contact with the first contact member, to open such conductive path.

According to another aspect of the invention, the conductive member is adapted to tilt in response to an intermediate signal about an axis defined by its locations of contact with the two contact members, against the operator or button of a snap-action auxiliary switch forming a part of a different circuit.

Various additional aspects, features, objects and advantages of the invention will be understood from reading the description of the preferred embodiment which follows, and from the appended claims.

BRIEF DESCRIPTION OF THE DRAWING

In the drawing like reference numerals denote corresponding parts throughout the several views, and:

FIG. 3 is a longitudinal sectional view taken through the switch mechanism, substantially along line 3 — 3 of FIG. 4, said view showing the relative relationship of the several parts of the switch mechanism when assembled;

FIG. 4 is a plan view of the switch mechanism, looking towards the terminal end thereof, and showing some internal parts in phantom;

FIG. 13 is a plan view of the conductive member, showing its locations of contact with other parts of the switch mechanism and its axes of pivotal movement.

DESCRIPTION OF THE PREFERRED EMBODIMENT

Figure 1:
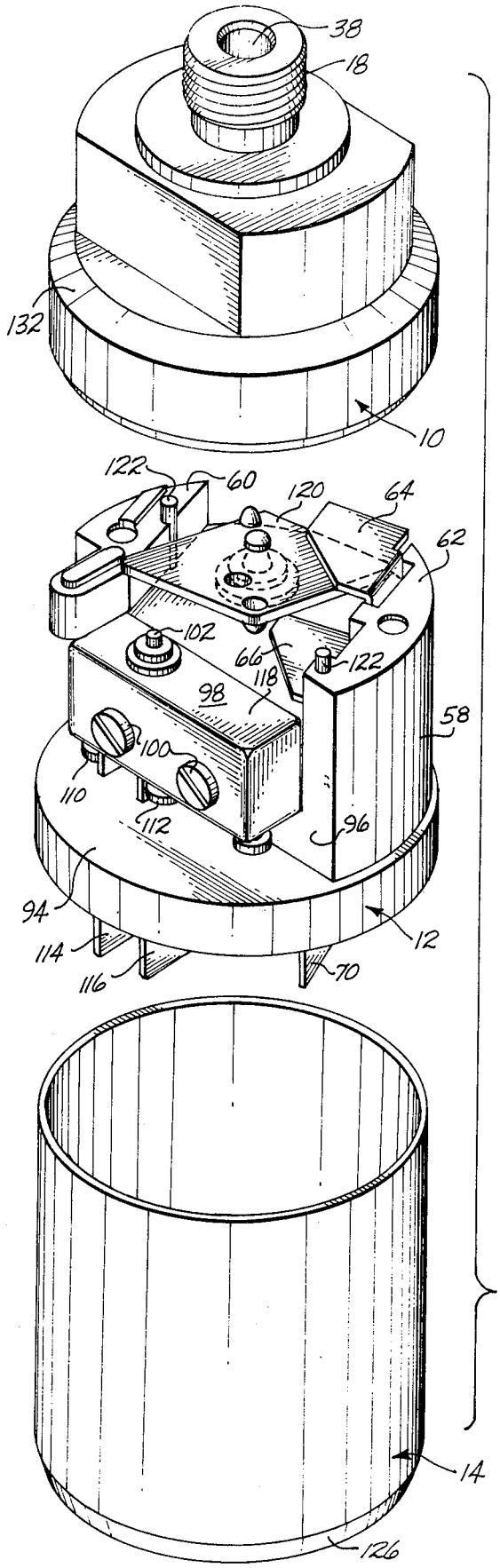
FIG. 1 is an exploded pictorial view of an embodiment of the invention, taken from above.

Referring more specifically to the several figures of the drawing, the switch mechanism is shown to comprise three major components. These are a sensor portion 10, an electrical parts portion 12 and an outer casing 14.

Figure 2:
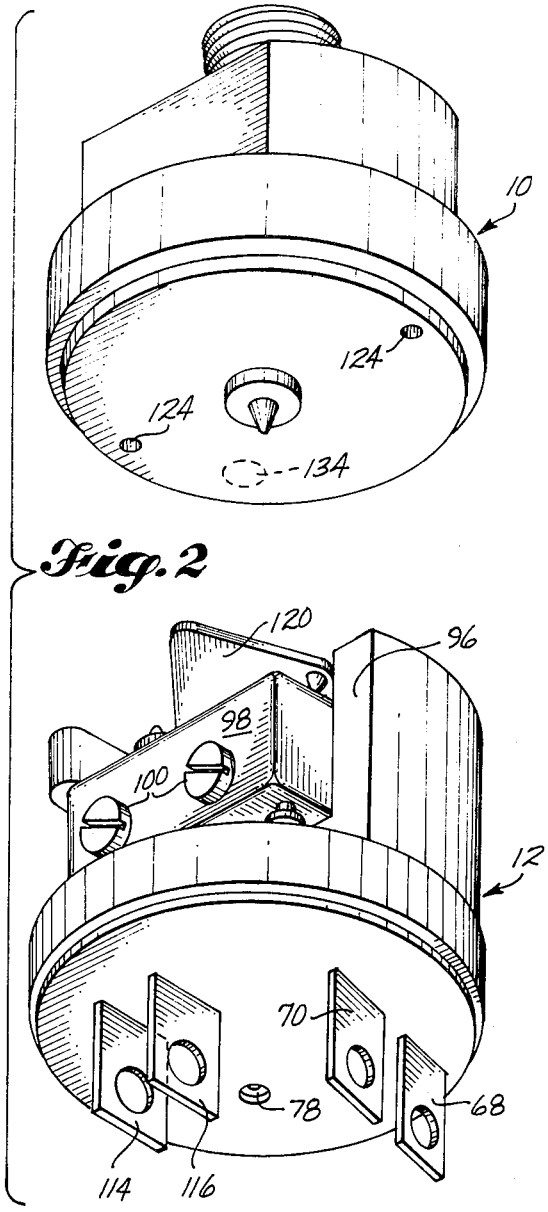
FIG. 2 is an exploded pictorial view of such embodiment, taken from below, but with the outer casing omitted.

As shown by FIGS. 1, 2 and 3, the sensor portion 10 comprises a main body 16 having an exteriorly threaded stem 18 at its outer end and a shallow cavity at its inner end. A generally disc-shaped insert 22, formed of an electrically insulative material, is received within the cavity 20. A flexible wall or diaphragm 24 is located between the insert 22 and the base of the cavity 20. Preferably, the insert 22 is formed to include an annular ridge 26 or the like which is adapted to engage and grip the peripheral portion of diaphragm 24 when all parts of sensor portion 10 are assembled. Insert 22 may also be formed to include a conical surface located immediately radially outwardly of the annular ridge 26. When the several parts are assembled an O-ring 30 is contacted and compressed by and between this surface 28 and the cylindrical wall 32 of cavity 20, to provide a fluid tight static seal between body 16 and insert 22. Insert 22 may be formed to include a peripheral flange 34, adapted to be received within, and retained by, an annular channel formed in part by an annular lip 36 provided at the inner end of body 16. The lip 36 is initially cylindrical in shape. After the diaphragm 24 and the insert 22 are installed into the cavity 20 the lip 36 is rolled inwardly into tight engagement with the flange 34.

Body 16 is formed to include an axial passageway 38 having an enlarged inner end 40 where it meets the diaphragm 24. A force applying member 42, constructed from a suitable hard material, makes contact with the central portion of diaphragm 24. Insert 22 includes a two part central passageway for member 42. The first part 44 is relatively small in diameter and is sized to receive and pass a relatively small diameter portion 46 of member 42 and is too small to pass a larger diameter base portion 48 of member 42. The second and larger diameter portion 50 of the central passageway in insert 22 is sized to receive base portion 48 of member 42. Load applying member 42 may include a conical end portion 52, the purpose of which will be hereinafter discussed.

The stem portion 18 of body 16 is tightly screwed into an internally threaded opening formed in a wall of a chamber 54 containing a pressure fluid. This communicates the pressure fluid with the passageway 38, cavity 40, and the side of diaphragm 24 opposite the load applying member 42. As should be evident, a progressive increase of pressure within cavity 40 and against the diaphragm 24 will extend the load applying member 42 progressively outwardly through orifice 44. Member 42 will continue to move outwardly in response to an increasing pressure signal until its base portion 48 makes contact with shoulder 56. Similarly, commencing with a relatively large pressure in cavity 40, a progressive decrease in such pressure signal will result in a corresponding progressive retraction of member 42.

The electrical parts portions 12 of the switch mechanism includes a main body 58 which is preferably constructed from an insulative material. It is shown (FIG. 1) to include inner end portions 60, 62 which when the parts are assembled make contact with corresponding surface portions of the inner end of sensor portion 10 (i.e. the exposed face of insert 22). Body 58 is recessed at its inner end between the two end portions 60, 62. First and second contact members 64, 66 are provided on the side of the recess bordered by end member 62. The contact members 64, 66 are insulated from each other by the insulative material which makes up body 58. The first contact member 64 is both spaced laterally from, and vertically above (as pictured in FIG. 1) the second contact member 66. Contact member 64 is a transverse end portion of a conductive bar which extends axially through insulative body 58 and at the outer end thereof projects as a terminal 68. Contact member 66 is a transverse end portion of a second conductive bar member which extends axially through insulative body 58 and also projects as a terminal 70 (FIGS. 2 and 4). As illustrated in FIG. 1, contact member 66 is located substantially at the base of the end recess of body 58, whereas contact member 64 is spaced above such base and is substantially even with the end surface of end portion 62.

As best shown by FIG. 3, insulative body 58 includes an inwardly opening socket 72 communicating at its outer end with first a hexagonal recess 74 for a nut 76 and then a smaller dimension opening 78. An adjustment screw 80, having an Allen wrench receiving socket 82 (FIG. 4) at its outer end, is threaded into the nut 76. Nut 76 is held against rotation by its mating fit within the recess 74. The inner end of adjustment screw 80 bears against a disc 82 which in turn contacts the outer end of a coil type compression spring 84. The inner end of spring 84 rests against a shoulder portion 86 of a biasing member 88. Biasing member 88 may include an elongated stem portion which extends downwardly through the open center of the coil spring 84. Preferably, it also includes a conical point portion 92 which is directed in the opposite direction from the conical point portion 52 of load applying member 42. In the preferred embodiment, both load applying member 42 and biasing member 88 are mounted for reciprocating rectilinear travel. Their movement is along axes which are parallel to each other. The axis of travel of load applying member 42 coincides with the center line axis of the switch mechanism, whereas the line of travel of biasing member 88 is radially offset from such center line.

As best shown by FIGS. 1 and 2, the insulative body 58 is formed to include a side recess defined generally by a radial surface 94 and a chord surface 96. A self-contained auxiliary switch 98 is located within this recess, and is shown to be attached to the chord surface 96 by a pair of screws 100. The auxiliary switch 98 may be a Micro (trademark) brand snap-action switch or the like. In FIGS. 6, 8, 10 and 12 it is schematically shown to include a reciprocating button or operator 102 which is connected to a movable conductor 104. Conductor 104 is adapted to bridge between a pair of conductors 106, 108 when the operator 102 is depressed. In FIGS. 1, 3, and 4, the switch 98 is shown to include a pair of conductors having headed ends 110, 112 which, when auxiliary switch 98 is secured to insulative body 58, makes conductive contact with the inner ends of a pair of parallel conductive bars, shown to project axially through insulative body 58, and endwise outwardly therefrom as terminals 114, 116. Conductive members 110, 114 and 112, 116 together form the conductors which are schematically shown in FIGS. 6, 8, 10 and 12, and designated 106, 108 therein.

As shown by several of the figures, including FIGS. 1 and 3, the operator 102 projects axially of the electrical parts portion 12 from adjacent the level of the base of the inner end recess formed in insulative body 58. In other words, the operator 102 projects outwardly from the inner boundary 118 of auxiliary switch 98 and such inner boundary 118 is substantially even with the base surface of the recess.

As best shown by FIG. 1, a conductive member 120, which in the illustrated embodiment is a plate in the shape of a parallelogram, is supported on the biasing member 88, with a corner portion thereof under the first contact member 64. The biasing spring 84, acting on contact member 120 via the biasing member 88 holds the conductive member 120 against contact member 64. As will be hereinafter be explained in some detail, when the sensor and electrical parts portions 10, 12 are together, the point portion 52 of load applying member 42 makes contact with the conductive member 120 at a location offset from the contact made by the biasing member 88. Also, a corner portion of conductive member 120 makes contact with an inner end surface portion of the insulative insert 22.

The insulative body 58 may be formed to include axially inwardly extending locating pins 122, formed on the end portions 60, 62 for engaging a pair of sockets 124. When the locator pins 122 are positioned within the sockets 124 the sensor portion 10 is exactly axially aligned with the electrical parts portion 12, and the load applying member 42 makes proper contact with the conductive member 120. FIG. 3 shows the two portions 10, 12 joined and the outer casing 14 in place for holding them together, making the switch mechanism a single unit having the electrical terminals 68, 70, 114, 116 at one of its ends and the threaded connector 18 for a pressure signal conduit at its opposite end. As shown by FIG. 1, one end of casing 14 may have a prerolled edge 126, adapted to engage a chamfered surface 128 provided at the periphery of the terminal end of insulative body 58. Following assembly of the two portions 10, 12 together, and within casing 14, the opposite end of the casing 14 may be provided with a rolled edge 130 which is moved into tight engagement with a second chamfer 132 formed on body 16.

Referring now to FIG. 13, the conductive member 120 is shown to comprise a rounded nipple which in the assembled switch mechanism contacts the inner end of insulative member 22, at the encircled region designated 134 in FIG. 2. The location of contact of such nipple with such surface is designated A in FIG. 13. A similar nipple is provided at an adjacent corner portion of conductive member 120, for contact with the undersurface of elevated contact member 64, at contact location B. At the next corner, moving clockwise around conductive member 120 as it is illustrated in FIG. 13, another nipple is provided on the opposite side of conductive member 120, to make contact with the second contact member 66, at a contact location designated C. The fourth corner of conductive member 120 is adapted to make contact with the projecting rounded end portion of auxiliary switch operator 102, the location of contact being designated D.

Figure 5:
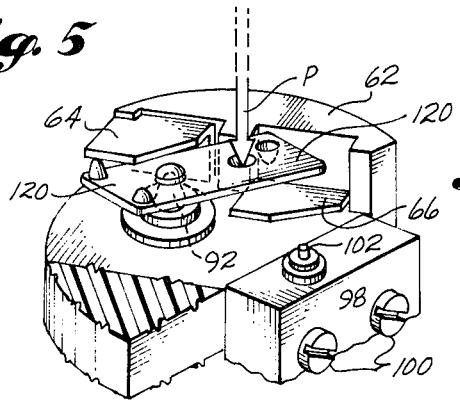
FIG. 5 is a fragmentary pictorial view, taken from above, of the inner end of the electrical portion of the switch mechanism, with no external load applied thereto.
Figure 6:
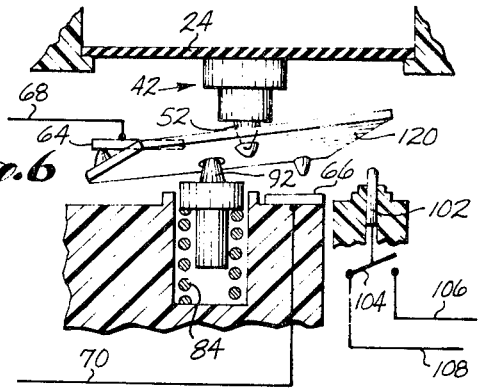
FIG. 6 is an elevational view of the portion of the switch mechanism shown by FIG. 5, with some parts shown in section and other parts presented in schematic form.
Figure 7:
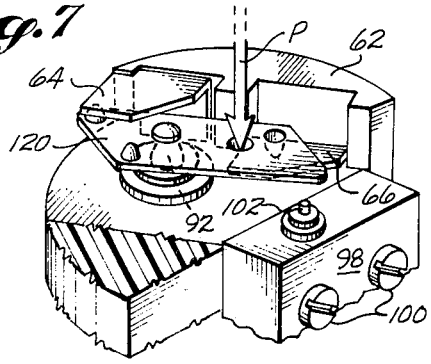
FIG. 7 is a view like FIG. 5, showing the condition of the switch mechanism subjected to a low load.
Figure 8:
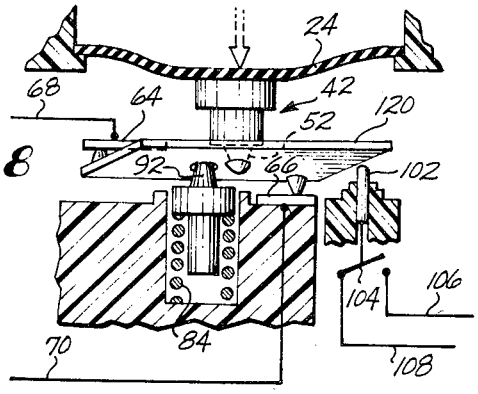
FIG. 8 is a view like FIG. 6, of the switch mechanism subject to the low load.
Figure 9:
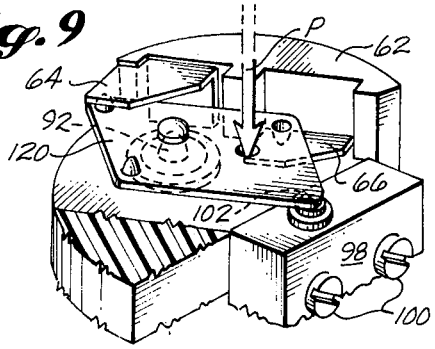
FIG. 9 is a view like FIGS. 5 and 7, but of a switch mechanism subjected to an intermediate load.
Figure 10:
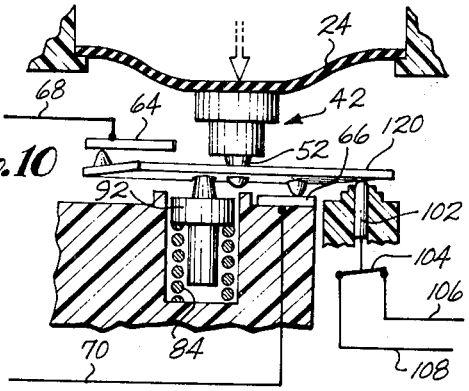
FIG. 10 is a view like FIGS. 6 and 8, but of a switch mechanism subjected to the intermediate load.
Figure 11:
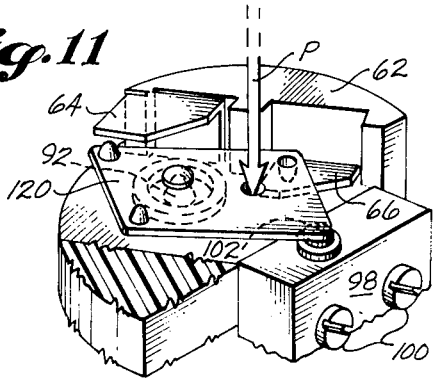
FIG. 11 is a view like FIGS. 5, 7 and 9, but of a switch mechanism subjected to a high load.
Figure 12:
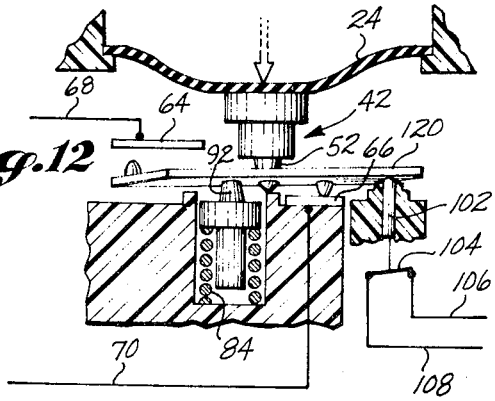
FIG. 12 is a view like FIGS. 6, 8 and 10, but of the switch mechanism subjected to the large load.

The operation of the switch mechanism will now be described:

Let it be assumed that the inlet end 18 of the switch mechanism is connected to a conduit having an opposite end which is connected to a chamber containing a fluid under pressure which is subject to changes in pressure. Let it also be assumed that the switch mechanism is initially at the static or unloaded condition shown by FIGS. 3, 5 and 6, for example. Let it now be assumed that the pressure acting on diaphragm 24 starts to steadily increase. At a first predetermined pressure level, which may be considered to be a low pressure level, the pressure fluid acting on diaphragm 24 will displace the load applying member 42 axially outwardly. As it moves it exerts a force on the conductive member 120, acting at the end of a relatively long moment arm *x,* causing the conductive member 120 to pivot or tilt about a line or first axis $a_1$ until conductive member 120 makes contact with the second contact member 66. When this happens a conductive path will be established by conductive member 120 between the two contact members 64, 66. The contact members 64, 66 may be parts of a first electrical circuit which is arranged to cause a particular thing to happen in response to a rise in pressure to said predetermined low level.

When the pressure within chamber 40 increases further to a second or intermediate level, at which time the load applying member 42 is projected outwardly a second predetermined amount, the force applied by it against conductive member 120, which may be termed an intermediate force, will act about a shorter moment arm *y,* and will cause the conductive member to pivot about axis $a_2$ until it contacts and depresses the operator 102, at contact location D. Auxiliary switch 98 is a part of a second circuit, adapted to cause a predetermined thing to happen in response to a rise in pressure within the pressure chamber to the intermediate level.

Then, when the pressure acting on diaphragm 24 increases to yet an additional amount, substantially increasing the force applied by member 42 against conductive member 120, such high or upper level force, acting at the end of a relatively small moment arm *z,* will cause the conductive member 120 to pivot in position about a third axis $a_3$, until contact at location B is broken.

In each of the above three described situations the force applied against conductive member 120 by the force applying member 42 is countered by the force of the spring 84, exerted via the biasing member 88. In the case of rotation about the first axis $a_1$, the force of spring 84 is applied at the end of a moment arm *r.* In the case of rotation about axis $a_2$, the force of spring 84 is applied at the end of a larger moment arm *s.* In the case of rotation about the third axis $a_3$, the force of spring 84 is applied at the end of a third and still larger moment arm *t.*

In the illustrated embodiment the contact point 52 makes contact with the conductive member at a location P which is inwardly of member 120 from all three axes $a_1$, $a_2$, $a_3$. Such location P is closer to axis $a_3$ than to either of the other two axes, but is closer to axis $a_2$ than it is to axis $a_1$. The location of contact S of point 92 with conductive member 120 is also spaced laterally inwardly of member 120 from each of the three axes $a_1$, $a_2$, $a_3$. It is closer to axis $a_1$ than to either of the other two axes $a_2$, $a_3$ but is closer to axis $a_2$ than it is to axis $a_3$.

As should be easily recognized, the magnitude of the force required to make each of the above-identified three movements of the conductive member 120, and hence cause the three operating conditions of the switch mechanism, are initially determined by (1) the relative spacing of the several contact locations A, B, C, D, P, S which establish the lengths of the several moment arms *x, y, z* and *r, s, t,* and the amount of movement of member 120, and by (2) the force of the biasing spring 84. The adjustment screw 78 provides a way of adjusting the force of the biasing spring 84.

It is evident that the relative distance of S and P from each of the three axes determines the relative pressures at which each rotation occurs, depending on the leverage P has over S in each case. It should be further apparent that leverage about each axis may be changed without affecting the leverage about the other two axes. Thus the relative pressures for each function may be adjusted at will by design of the lever.

It should also be apparent that adjustment of the spring force and pressure area will adjust the actual pressures at which the functions occur, thus providing complete freedom of design of the actual as well as relative pressure levels at which the switch functions.

It is to be recognized that other embodiments of the invention may be made in which only some of the features of the illustrated embodiment are utilized. For example, an embodiment of the invention may totally eliminate the auxiliary switch 98, so that a first sensed signal will complete the conductive path between conductive member 64 and conductive member 66, by rotating conductive member 120 until it makes contact at location C, and a second sensed signal may open such conductive path by breaking the contact at location B. Also, it is to be recognized that the "open" condition of any embodiment of the invention may be interchanged with a "closed" condition by making changes in the circuit design. Also it is obvious that any or all of the points A, B, C, and D could either form single electrical contacts or actuate independent snap-action switches; consequently considerable latitude in switching circuitry is also possible in the design of the pressure switch.

What is claimed is:

1. A switch mechanism comprising:

first and second spaced apart fixed contact members which are electrically insulated from each other and which in use form parts of an electrical circuit;

a movable conductive member which is not connected to either one of said contact members but underlies the first contact member and overlies the second contact member;

a biasing member which is electrically insulated from both of said contact members, making point contact with said conductive member at a location that is offset from both of said contact members on the side of said conductive member facing towards the second contact member;

means mounting said biasing member for reciprocating movement along a line which includes its point of contact with the conductive member and which extends generally transversely of said conductive member;

spring means normally biasing said biasing member towards said conductive member and said conductive member into contact with said first contact member and into a spaced relationship with the second contact member;

a load applying member making contact with said conductive member at a location spaced towards the second contact member from both the first contact member and the biasing member, and on the side of said conductive member opposite the second contact member;

means supporting said load applying member for movement along a line which includes its location of contact with the conductive member and which also extends generally transversely of the conductive member; and with the relative spacing of the first and second contact members, the contact point of the biasing member with the conductive member, and the location of contact of the load applying member with the conductive member, being such that a first movement of the load applying member towards the conductive member will pivot the conductive member in position about a first axis which includes its location of contact with the first contact member, to depress said biasing member, compress said spring means, and move said conductive member into contact with the second contact member and complete a conductive path through the conductive member from one of the contact members to the other, and a subsequent additional movement of the load applying member in the same direction will cause the conductive member to pivot in position about an axis which includes its location of contact with the second contact member, to further depress said biasing member, further compress said spring means, and move said conductive member out of contact with the first contact member to in that manner open said conductive path.

2. A switch mechanism according to claim 1, further comprising an auxiliary switch which in use forms a part of a second electrical circuit, said auxiliary switch including a reciprocating operator which is positioned to be contacted by said movable conductive member and be moved by it to operate said auxiliary switch mechanism in response to an intermediate movement of the load applying member against said conductive member in the same direction as said first and subsequent movements.

3. A switch mechanism according to claim 1, further comprising a support member on the same side of said conductive member as said load applying member, said support member being electrically insulated from said first and second contact members and normally contacting said movable conductive member at a location spaced from the location of contact between said conductive member and the first contact member, and wherein the location of contact between said support member and said conductive member and the location of contact between the conductive member and the first contact member together define the said first axis about which the conductive member pivots in response to the first movement of the load applying member.

4. A switch mechanism according to claim 2, wherein the location of contact of the conductive member with the first contact member, and the location of contact of the conductive member with the second contact member following the first movement of the load applying member, together define a second axis, from which the location of contact of the load applying member with the conductive member is laterally offset, and about which the conductive member pivots in response to an intermediate movement of the load applying member, when moving into contact with the operator of the auxiliary switch.

5. A switch mechanism according to claim 2, wherein the location of contact of the conductive member with the second contact member and the location of contact of the conductive member with the operator of the auxiliary switch together form an axis from which the location of contact of the load applying member with the conductive member is laterally offset, and about which said conductive member pivots in response to the subsequent additional movement of the load applying member, when moving out of contact with said first contact member.

6. A switch mechanism according to claim 5, wherein the location of contact of the conductive member with the first contact member and the location of contact of the conductive member with the second contact member, following the first movement of the load applying member, together define an axis, from which the location of contact of the load applying member with the conductive member is laterally offset, and about which the conductive member pivots in response to an intermediate movement of the load applying member, when moving into contact with the operator of the auxiliary switch.

7. A switch mechanism according to claim 6, wherein said conductive member is in the form of a substantially flat plate having four corner positions, wherein the locations of contact of said conductive member with said first and second contact member are at adjacent corner portions of said conductive member, wherein said switch mechanism also includes a support member on the same side of said conductive member as said load applying member, said support member being electrically insulated from said first and second contact members and normally contacting said conducting member at a third corner portion location which is spaced diagonally across the conductive member from the location of contact of said conductive member with the second contact member, wherein the location of contact between said support member and said conductive member and the location of contact between the conductive member and the first contact member together define the said first axis about which the conductive member pivots in response to the first movement of the load applying member, wherein the location of contact of the conductive member with the operator of the auxiliary switch is at the fourth corner portion location on said conductive member, diagonally across the conductive member from the location of contact of the conductive member with the first contact member, and wherein the location of contact of the load applying member with the conductive member is spaced laterally inwardly of the conductive member from each of the axes.

8. A switch mechanism according to claim 7, wherein the location of contact of the load applying member with the conductive member is located closer to the axes of rotation formed by the locations of contact of the conductive member with the operator of auxiliary switch mechanism and with the second contact member than it is to the other two axes, and is located closer to the axis of rotation formed by the locations of contact of the conductive member with the first and second contact members than it is with the axis formed by the locations of contact of the conductive member and with the first contact member.

9. A switch mechanism according to claim 1, further comprising means for receiving a pressure signal and applying it against said load applying member, for causing the said movement of the load applying member.

10. A switch mechanism comprising:

a first portion having inner and outer ends and including first and second spaced apart fixed contact members at its inner end which are electrically insulated from each other, said contact members including conductive leg portions which extend through said first portion and project as first and second terminals at the outer end of said first portion;

a movable conductive member which is not connected to either one of said contact members but underlies the first contact member and overlies the second contact member;

a biasing member which is electrically insulated from both of said contact members, making contact with said conductive member at a location which is offset from both of said contact members on the side of said conductive member facing towards the second contact member;

means mounting said biasing member for reciprocating movement along a line which includes its location of contact with the conductive member and which extends generally transversely of said conductive member;

spring means normally biasing said biasing member towards said conductive member and said conductive member into contact with said first contact member and into a spaced relationship with the second contact member;

a second portion having inner and outer ends, and including at its inner end a support surface which makes contact with the movable conductive member at a location spaced from the location of contact of the conductive member with the first contact member, and carrying a reciprocating load applying member making contact with said conductive member at a location closely adjacent the second contact member, but on the side of said conductive member opposite the second contact member;

means supporting said load applying member for movement along a line which includes its location of contact with the conductive member and which also extends generally transversely of the conductive member;

means holding the first and second portions of the switch mechanism together, with the load applying member and the support surface of said second portion in contact with the conductive member carried by the first portion; and with the relative spacing of the first and second contact members, the contact location of the biasing member with the conductive member, and the locations of contact of the load applying member and the support surface with the conductive member, being such that a first movement of the load applying member towards the conductive member will pivot the conductive member in position about a first axis defined by its location of contact with the first contact member and with the support surface, to depress said biasing member, compress said spring means, and move said conductive member into contact with the second contact member and complete a conductive path through the conductive member from one of the contact members to the other, and a subsequent additional movement of the load applying member in the same direction will cause the conductive member to pivot in position about an axis which includes its location of contact with the second contact member, to further depress said biasing member, further compress said spring means, and move said conductive member out of contact with the first contact member to in that manner open said conductive path.

11. A switch mechanism according to claim 10, wherein the second portion of the switch mechanism includes means for receiving a fluid pressure signal and applying it against the load applying member to cause the movement of the load applying member.

12. A switch mechanism according to claim 11, wherein said first portion of the switch mechanism carries an auxiliary switch which includes a pair of conductive legs which extend through said first portion and project as terminals out from the outer end thereof, said auxiliary switch also including a reciprocating operator which is positioned to be contacted by said movable conductive member and be moved by it to operate said auxiliary switch mechanism in response to an intermediate movement of the load applying member against said conductive member in the same direction as said first and subsequent movements.

* * * * *

UNITED STATES PATENT OFFICE

CERTIFICATE OF CORRECTION

Patent No. 4,048,455 Dated September 13, 1977

Inventor(s) Alan K. Forsythe, Charles J. Green

It is certified that error appears in the above-identified patent and that said Letters Patent are hereby corrected as shown below:

Claim 7, column 8, line 67, "positions" should be -- portions --.

Claim 8, column 9, line 37, after "member" insert -- with the support member --.

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*